United States Patent [19]

Mowry, Jr.

[11] Patent Number: 4,749,213

[45] Date of Patent: Jun. 7, 1988

[54] SECURE FINANCIAL INSTRUMENT

[75] Inventor: William H. Mowry, Jr., Ionia, N.Y.

[73] Assignee: The Standard Register Co., Dayton, Ohio

[21] Appl. No.: 794,986

[22] Filed: Nov. 4, 1985

[51] Int. Cl.[4] ..... B42D 15/00

[52] U.S. Cl. ..... 283/58

[58] Field of Search ..... 283/58; 40/530; 235/3, 235/17; 101/426; D19/11; 434/190, 192, 193, 194

[56] References Cited

U.S. PATENT DOCUMENTS

| | | | |
|---|---|---|---|
| 592,533 | 10/1897 | Rogers et al. | 283/58 |
| 936,399 | 10/1909 | Angell | 283/58 |
| 1,144,742 | 6/1915 | Todd et al. | 283/58 |
| 1,564,724 | 12/1925 | Todd et al. | 283/58 |
| 2,934,834 | 5/1960 | Latty | 434/193 |
| 3,112,151 | 11/1963 | Buros | 283/58 |
| 3,381,394 | 5/1968 | Monro | 434/193 |
| 3,983,814 | 10/1976 | Baker | 101/426 |
| 4,175,774 | 11/1979 | Tonges et al. | 283/58 |
| 4,234,214 | 11/1980 | Lee | 283/58 |
| 4,645,240 | 2/1987 | Whitehead | 283/58 |

FOREIGN PATENT DOCUMENTS

| | | | |
|---|---|---|---|
| 692505 | 11/1930 | France | 283/58 |
| 4119 | of 1903 | United Kingdom | 434/194 |

*Primary Examiner*—Paul A. Bell

*Attorney, Agent, or Firm*—Killworth, Gottman, Hagan & Schaeff

[57] ABSTRACT

A numbering system is disclosed for use on financial instruments which due to the unique shape and size of each number the financial instrument is secure from having the sums raised through the commonly used cut and paste technique.

11 Claims, 3 Drawing Sheets

SECURE FINANCIAL INSTRUMENT

BACKGROUND OF THE INVENTION

Many techniques have been proposed to protect financial documents such as checks and money orders from having the amount raised by alteration. Safety papers have been developed which have chemically reactive coatings which can change color or bleach out a color and reveal words such as "VOID" to show that an attempt has been made to alter the document. Printing techniques have also been used on the back of documents using an ordered large repeating pattern any change in which should be quickly detected by the human eye.

In order to frustrate the above mentioned protection techniques, persons interested in altering a check or money order have developed a cut and paste scheme. In the cut and paste method of alteration a person would go to a bank, store or post office and get two money orders. One money order could be for $9.00 and the second for $100.00. Using a scalpel the person would carefully remove the 9 from the first money order and the 1 from the second. The 9 would then be pasted into the area where the 1 had been removed thereby raising the money order to $900.00. On presenting the money order for cashing, the paper stock would appear as usual thereby not alerting the clerk that an alteration had been made.

BRIEF SUMMARY OF THE INVENTION

The present invention relates to a method of preparing secure financial instruments and to the secure financial instruments. According to the present invention two sets of distinct shape and size numbers are used to enter the amount on the financial instrument. The number set for the major amount, such as dollars, is in large negative or white on black pattern or in an outline pattern while the number set for the minor amount, such as cents, is in a smaller positive or black on white pattern. The terms "white on black" and "black on white" are relative since the "white" could be the same as the background colors on the instrument while the "black" depends on the printing ink used and color developed on the paper. Each of the numbers from 0 through 9 has a distinct size and shape which prevents one number from being superimposed or pasted into a document in place of another without the attempted alteration being clearly visible. The numbers can be added to a blank instrument through the use of programmable printers or die sets cut in the shape of the numbers. A dot matrix printer is preferred in view of the infinitely variable print available.

In the preferred embodiment of the present invention a dot matrix printer is used in combination with a conventional print ribbon having a penetrating oil in the ink vehicle to wet the paper fibers. In adding the amount to the financial instrument the printer would also add a word or symbol such as "PAY ONLY" to the immediate left of the highest order number. No additional higher order numbers can than be added in an attempt to raise the value of the instrument.

DESCRIPTION OF THE INVENTION

In FIGS. 1A through 1J the individual digits of a number set of the present invention are shown. Each of the digits 0 through 9 has distinct size and shape and has a unique area included within a rectangle bounding the configuration of the digit. To assist in identification the name of each digit can be included within the configuration. The English names are illustrated in FIGS. 1A through 1J. The digit names can be changed to correspond to the language of any country where the number set is used. The number set for the major denomination can be used as an outline pattern or preferably in a negative pattern. The negative pattern is preferred since excess ink has to be removed or added to alter a number. It is very difficult to remove the ink without damaging the document. It is also difficult to add ink to match the other numbers.

FIGS. 2A through 2J illustrate a second number set of the present invention. Each of the digits 0 through 9 has a distinct size and shape and has a unique area included within a rectangle bounding the configuration of the digit. The number set is also intended to be colored and have a substantial contrast to the number set of FIGS. 1A through 1J.

Figure 1A:
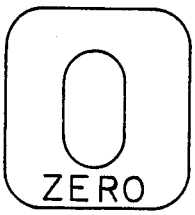
FIGS. 1A through 1E illustrate an outline number set used for major denominations on a financial instrument.
Figure 1B:
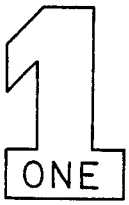
Figure 1C:
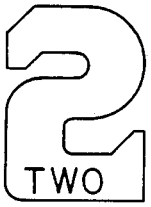
Figure 1D:
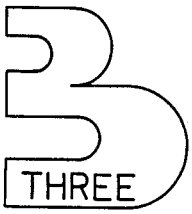
Figure 1E:
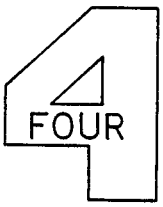
Figure 1F:
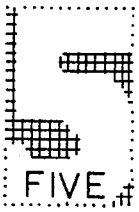
FIGS. 1F through 1J illustrate a negative number set used for major denominations on a financial instrument.
Figure 1G:
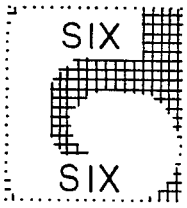
Figure 1H:
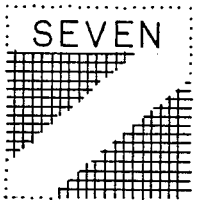
Figure 1I:
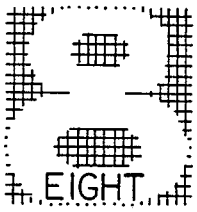
Figure 1J:
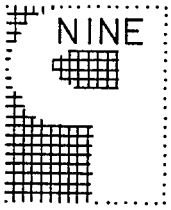
Figure 2A:
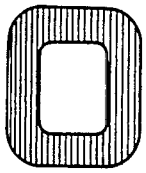
FIGS. 2A through 2J illustrate a number set used for minor denominations on a financial instrument.
Figure 2B:
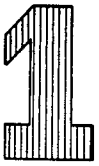
Figure 2C:
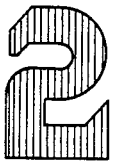
Figure 2D:
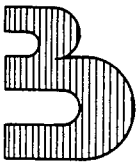
Figure 2E:
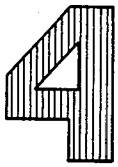
Figure 2F:
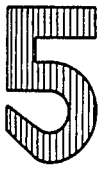
Figure 2G:
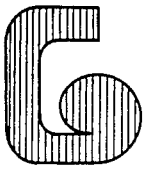
Figure 2H:
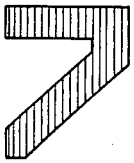
Figure 2I:
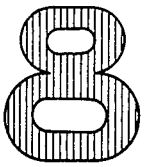
Figure 2J:
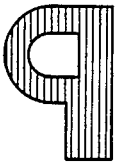
Figure 3A:
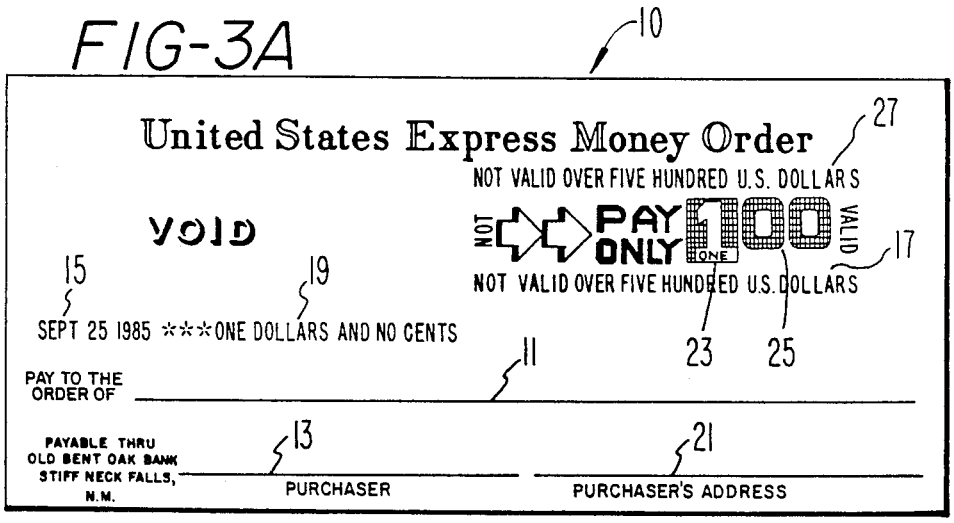
FIGS. 3A & 3B are plan views of a financial instrument illustrating the use of the number sets of FIGS. 1 and 2 to enter a sum of money.
Figure 3B:
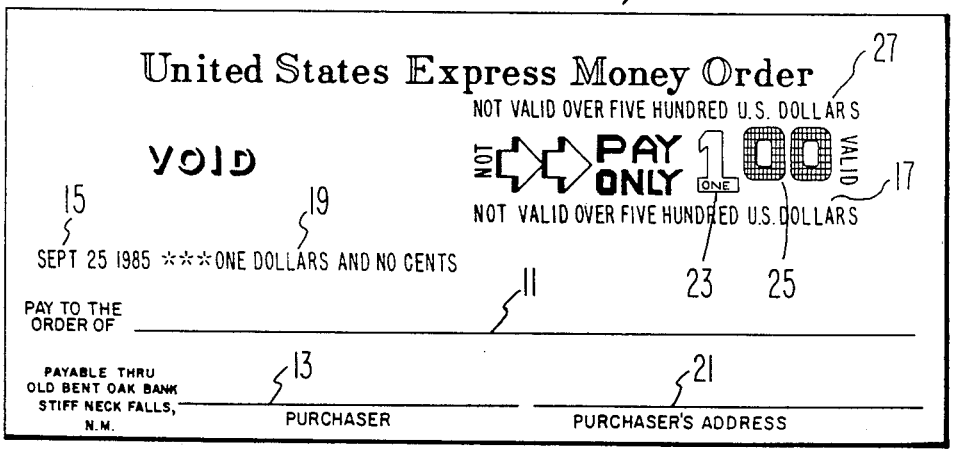

In FIG. 3, a representative negotiable instrument 10 is shown having a line 11 for the identification of the payee. A line 13 for the identification of the payor or purchaser. A place 15 for the date the negotiable instrument was prepared. An area 17 for the entry of the amount or value of the negotiable instrument and a place 19 where the same amount or value is spelled out. An area 21 is provided for entering the address of the payor or purchaser.

Referring now to the area 17, the amount or value of the negotiable instrument is shown having been entered onto the document through the use of the number sets of the present invention. The major amount 23, in this example dollars, has been entered using a negative digit selected from the number set or FIG. 1. The minor amount 25, in this case cents, has been entered using a digit selected from the number set of FIG. 2.

The number set or FIGS. 1A through 1J appears on the negotiable instrument 10 in a substantially white on black configuration. The number set of FIGS. 2A through 2J appears on the negotiable instrument 10 in a substantially black on white configuration. The terms "white on black" and "black on white" are relative. When the major amount 23 is entered on a negotiable instrument, the background color in the area 17 will be the color appearing within the bounds of the numbers. The color of the ink used in the printer along with any color formed in the area 17 through the use of a carbonless color developing system will determine the ultimate color of the "black" used to enter the minor amount 25.

For further document security the area 17 can be enclosed within a printed border 27 which sets forth the maximum amount which can be entered on the negotiable instrument. Also, immediately to the left of the highest order digit of the major amount 23 a mark or words such as "PAY ONLY" is used to prevent still higher order digits from being entered.

Figure 4:
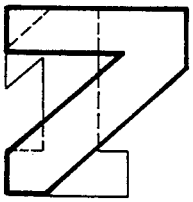
FIGS. 4, 5 and 6 illustrate the effect produced in attempting to raise a digit of the number sets by superimposing a higher order digit over a lower order digit.
Figure 5:
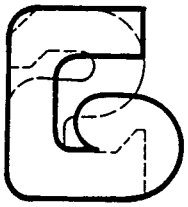
Figure 6:
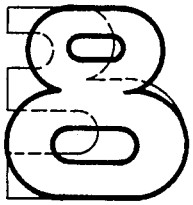

If an attempt is made to raise the amount of the negotiable instrument 10 by superimposing a higher order digit, for example and referring to FIG. 4, by using a 7 to replace the 1 it can be clearly seen that the alteration would be clearly visible due to the substantial difference in size and shape of the two digits. If the 1 was removed from the area 17 by the so called "cut and paste" technique, the difference in the size, shape and included rectangular area is such that the attempted alteration would be clearly visible. FIGS. 5 and 6 further illustrate the difference between digits with substantially similar major features. Even these digits would clearly show any attempt to alter the lower order digit.

In the example presented herein the English language has been used for the amount of the negotiable instrument and for a symbol such as "PAY ONLY". In countries where other languages are in use these same entries could be made in the appropriate language. Likewise the selection of a particular number set for the major and minor amount and the use of "white on black" or "black on white" is a matter of choice. The preferred embodiment is to use the number sets and color order as shown herein in relation to the example of FIG. 3.

What is claimed is:

1. A financial instrument having an amount printed on its face with a type font in which each of the numerals from 0 to 9 making up said type font has a distinct size, shape and a unique area included within a rectangle bounding each number and the size and shape of each numeral differs from the size and shape of each other numeral such that one numeral from said type font cannot be superimposed or pasted into said amount in place of another numeral from said type font without the attempted alteration being clearly visible.

2. A financial instrument as set forth in claim 1 in which the numbers for major currency units are printed in a negative pattern.

3. A financial instrument as set forth in claim 2 in which each number of the negative pattern includes within the pattern the name of the number.

4. A financial instrument as set forth in claim 1 in which each number for major currency units are printed in an outline pattern.

5. A financial instrument as set forth in claim 4 in which each number of the outline pattern includes within the pattern the name of the number.

6. A financial instrument as set forth in claim 1 in which the numbers for the minor currency units are printed in a positive pattern.

7. A financial instrument as set forth in claim 1 in which the amount is made up of different size numbers for the major and minor sums.

8. A financial instrument as set forth in claim 7 in which the numbers for the major amount are larger than the numbers for the minor amount.

9. A financial instrument having an amount printed on its face with numerals selected from the font substantially as shown in FIGS. 2A through 2J.

10. A financial instrument having an amount printed on its face with numerals selected from the font substantially as shown in FIGS. 1A through 1E.

11. A financial instrument having an amount printed on its face with numerals selected from the font substantially as shown in FIG. 1F through 1J.

* * * * *